United States Patent [19]

Rossman

[11] Patent Number: 4,676,024

[45] Date of Patent: Jun. 30, 1987

[54] EXPANSION FIT INTERIOR STORM WINDOW ASSEMBLY

[76] Inventor: John R. Rossman, 11001 Edgewater Dr., Cleveland, Ohio 44102

[21] Appl. No.: 861,159

[22] Filed: May 8, 1986

Related U.S. Application Data

[63] Continuation-in-part of Ser. No. 841,939, Mar. 20, 1986, which is a continuation of Ser. No. 634,463, Jul. 25, 1984, abandoned.

[51] Int. Cl.[4] ..... E05B 65/04

[52] U.S. Cl. ..... 49/62; 49/61

[58] Field of Search ..... 49/61, 62, 414, 463, 49/465

[56] References Cited

U.S. PATENT DOCUMENTS

| | | | |
|---|---|---|---|
| 961,726 | 6/1910 | Mayr . | |
| 1,123,088 | 12/1914 | Bryant . | |
| 1,525,002 | 2/1925 | Sembower . | |
| 1,740,960 | 12/1929 | Roberge . | |
| 1,858,109 | 5/1982 | Pauli . | |
| 1,873,399 | 8/1932 | Haskell | 49/61 |
| 2,280,142 | 4/1942 | Daniels | 49/61 |
| 2,398,017 | 4/1946 | Lidin | 49/62 |
| 2,402,112 | 6/1946 | Gee . | |
| 2,504,510 | 4/1950 | Ernest . | |
| 2,846,734 | 8/1958 | Zitomer . | |
| 3,095,617 | 7/1968 | Bruno . | |
| 3,349,517 | 10/1967 | Johnson | 49/61 |
| 3,745,704 | 7/1973 | Covington | 49/61 |
| 4,068,428 | 1/1978 | Peterson, III | 49/61 |
| 4,203,256 | 5/1980 | Mowry | 49/62 |
| 4,364,198 | 12/1982 | Netti . | |

FOREIGN PATENT DOCUMENTS

| | | |
|---|---|---|
| 872571 | 6/1971 | Canada . |
| 2621254 | 11/1977 | Fed. Rep. of Germany . |

*Primary Examiner*—Victor N. Sakran

*Attorney, Agent, or Firm*—Daniel J. Hudak Co.

[57] ABSTRACT

A unitary removable storm window assembly contains a window pane, a perimeter frame, and at least one side channel. The storm window assembly is unitary in that the side channel is interlockable with the perimeter frame so that the various components are fixed in relationship to one another even when the window is not in use, that is not installed. The storm window assembly contains at least one spring for urging the side channel away from the window perimeter. Thus, when placed within the jambs of an existing building or home window opening, the unitary window assembly is frictionally retained therein by the channels. The engagement is thus free from securing guides, tracks, and the like, and the entire window assembly is readily removable as a unitary structure within a matter of seconds.

5 Claims, 8 Drawing Figures

FIG. 7
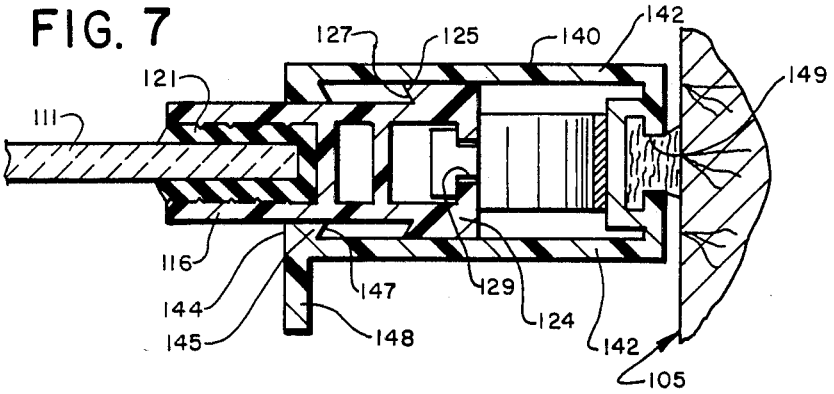
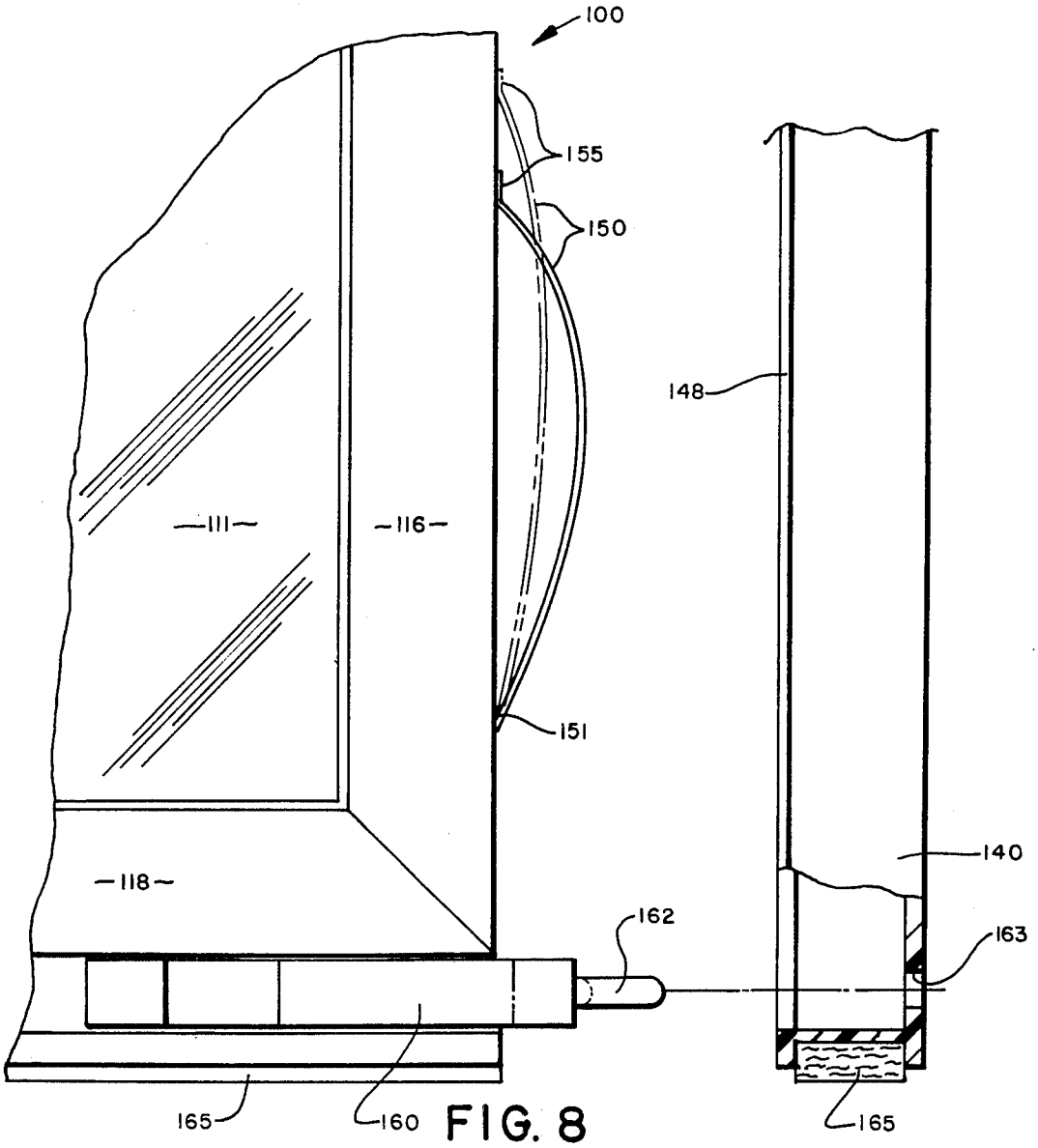
FIG. 8

EXPANSION FIT INTERIOR STORM WINDOW ASSEMBLY

CROSS REFERENCE

This application is a continuation-in-part of my earlier filed U.S. application for Expansion Fit Interior Storm Window Assembly bearing Ser. No. 841,939 and filed on Mar. 20, 1986, which in turn is a continuation of my copending application Ser. No. 634,463, filed July 25, 1984, and entitled Expansion Fit Interior Storm Window Assembly, now abandoned.

BACKGROUND OF THE INVENTION

The present invention relates to a unitary storm window assembly which is readily installed in an existing window opening. More specifically, the present invention relates to a unitary storm window held in place through a bias frictional fit and which is installed and removed in its entirety, that is, as an integral unit.

Heretofore, numerous so called "quick attachable" windows have existed which can be installed to an existing window opening containing an existing window and pane therein and are represented by the following patents.

U.S. Pat. No. 961,726 to Mayr relates to a double sliding sash window wherein an upper and a lower inner sash is slidable upon an outer upper and lower sash.

U.S. Pat. No. 1,123,088 to Bryant relates to providing an improved form of friction shoe for holding a screen or sash in a raised or lowered position.

U.S. Pat. No. 1,525,002 to Sembower relates to a pivoted and sliding window in which spring metal weather strips are interposed between the sliding stiles and the sides of a frame.

U.S. Pat. No. 1,740,960 to Roberge relates to detachable windows and screens as well as detachable guides for holding the same in place.

U.S. Pat. No. 1,858,109 to Pauli relates to an automobile window which partially closes a regular window opening whereby an operator's arm can be extended from an automobile to give manual signals.

U.S. Pat. No. 2,402,112 to Gee relates to a combined storm and screen window installation having an interchangeable sash which can be removed and is held in place by side channel irons.

U.S. Pat. No. 2,504,510 to Ernest relates to a device adapted to prevent the rattling of slidable windows as in an automobile.

U.S. Pat. No. 2,846,734 to Zitomer relates to an interior storm window which is applied to an existing window opening through guide members which are screwed to the frame of the existing window.

U.S. Pat. No. 3,095,617 to Bruno relates to an anti-bellying means for securing storm sashes to their adjacent frames.

U.S. Pat. No. 4,364,198 to Netti relates to a storm window unit having a bottom latch which window is added to an existing track.

Canadian Pat. No. 872,571 relates to a replaceable sash which is removably mounted in a window frame and which is secured to an existing opening.

German Pat. No. 26 21 254 relates to a replaceable window which is inserted in an existing opening.

While often relating to windows such as replaceable windows, none of the above documents relate to a unitary interior storm window assembly having side channels which interlock with a window perimeter frame and which assembly is frictionally fit in a sidewall jamb but is readily removable therefrom.

SUMMARY OF THE INVENTION

It is therefore an aspect of the present invention to provide a unitary interior window assembly.

It is a further aspect of the present invention to provide a unitary interior window assembly, as above, wherein said unitary window assembly is readily removable or insertable in its entirety.

It is a still further aspect of the present invention to provide a unitary window assembly, as above, wherein said unitary window assembly frictionally engages an existing window opening and hence requires no external fasteners, window tracks, window guides, and the like.

It is yet further aspect of the present invention to provide a unitary interior window assembly, as above, wherein side channels interlockingly engage a window perimeter frame.

It is yet an additional aspect of the present invention to provide a unitary interior window assembly, as above, wherein leaf springs urge at least one said side channel outward to create said frictional fit with the sidewall of an existing window opening.

These and other aspects of the present invention will become apparent from the following detailed description.

In general, a unitary interior storm window assembly comprising; a window pane, a perimeter frame, said window pane residing in said perimeter frame, at least one side channel, said side channel having interlocking tabs thereon, said side channel interlockingly connected to said perimeter frame so that a unitary window assembly is formed.

BRIEF DESCRIPTION OF THE DRAWINGS

The invention will be more fully understood from the following detailed description thereof when considered in connection with the accompanying drawing wherein the invention is illustrated by way of example and in which:

FIG. 7 is a top elevation view taken on line 7—7 of FIG. 4.

FIG. 8 is an enlarged fragmentated view of the lower right portion of FIG. 4 showing the latch mechanism.

DETAILED DESCRIPTION

Figure 1:
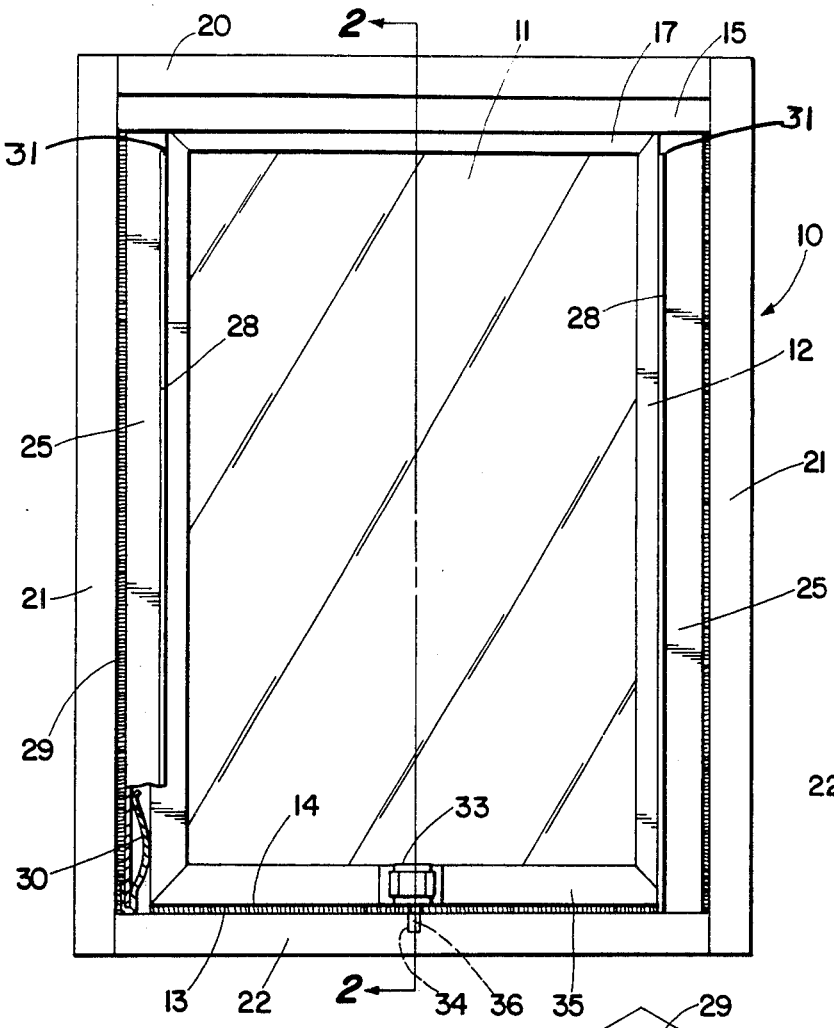
FIG. 1 is a front elevation view, broken away in part, of a storm window assembly according to the present invention.

Referring to the drawings, and more particularly to FIG. 1, there is shown an expansion fit interior storm window assembly generally referred to by reference numeral 10 according to the present invention. A window pane 11 made of glass or other suitable clear material is encased in a rigid perimeter frame 12. Suitable insulation 13 such as felt insulation is fastened to perimeter frame 12 by adhesive along the bottom edge 14 to seal against air leaking between frame 12 and existing window sill 22.

Figure 2:
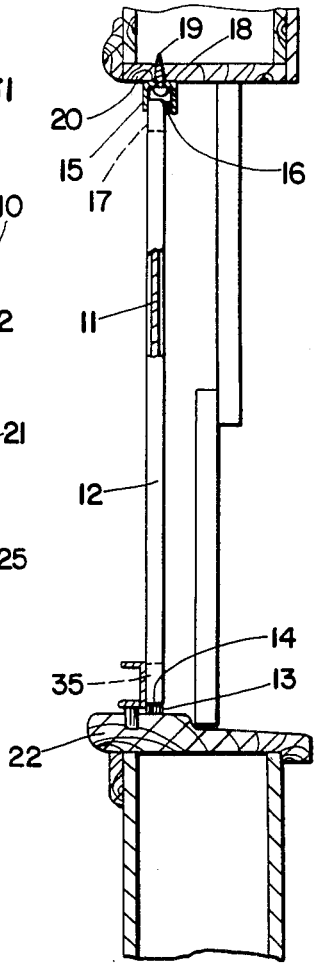
FIG. 2 is a side section view taken substantially through a plane indicated by section line 2—2 in FIG. 1 of the invention.

A "U" shaped top channel 15 extends the complete width and is permanently attached to the building existing window frame top 20 by screws 19 through channel bottom 18. Top channel 15 has insulation 16 provided on the inside of one leg 17 as shown in FIG. 2 to seal against air passing around perimeter frame 12 when inserted therein.

Figure 3:
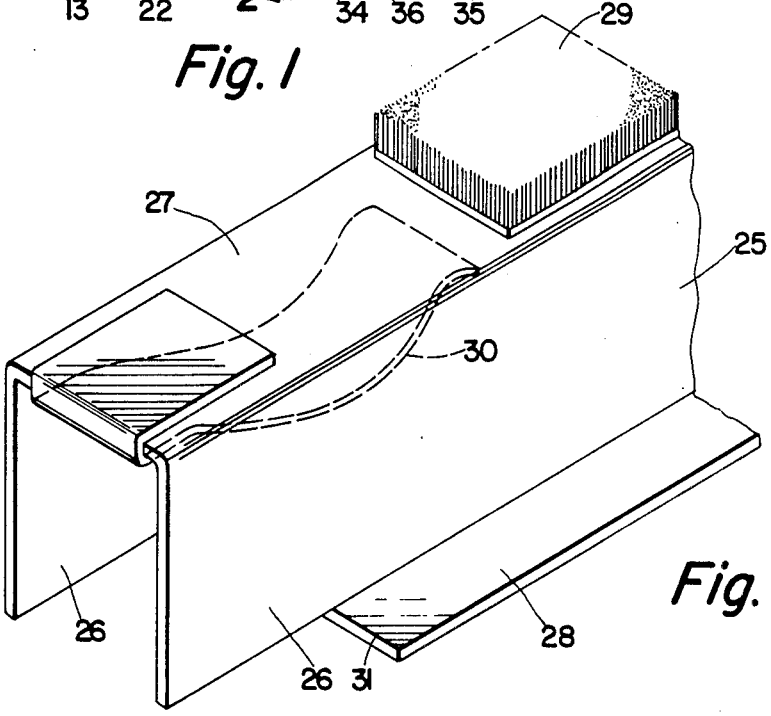
FIG. 3 is a partial perspective view of the end portion of the side channel of the invention.

Side channels 25 are also U-shaped and tightly enclose perimeter frame 12 within legs 26. A leaf spring 30 is clamped to the interior of side channel 25 on bottom 27 as shown in a broken away perspective view in FIG. 3. Additional leaf springs may similarly be attached to the middle portion of side channels 25 by cutting a slot in bottom 27. Insulation 29 such as felt is applied to the outside of side channel bottom 27 by a suitable adhesive. A tab 28 is formed in side channels 25 to aid in gripping them when installing and removing the assembly and pressing against the bias of leaf springs 30. The side channels 25 will thus expand against existing window frame sides 21 in tight frictional engagement due to the outward bias of leaf springs 30. Tabs 28 are indented at 31 to permit inserting side channels 25 in top channel 15.

The assembly 10 is safely held within the existing building window frame and is prevented from falling out by top channel 15 and frictional engagement by side channels 25 with existing window frame sides 21. To further prevent the assembly from popping out under severe wind conditions, a latch 33 is attached to perimeter frame bottom 35 and tongue 36 is provided to engage a hole 34 formed in window sill 22.

Perimeter frame 12, top channel 15 and side channels 25 are preferably made of aluminum but obviously can be made of other suitable materials such as extruded polyvinyl chloride. Leaf springs 30 are made of metal but likewise can be made of suitable plastic material having spring characteristics.

In installing the assembly 10, side channels 25 are inserted on perimeter frame 12 and pressed together by gripping tabs 28 and pressing inward against the bias of springs 30. The assembly is then inserted into top channel 15 and the existing window frame. Side channels 25 are released and they are expanded to frictionally engage window frame sides 21. Side channels 25 and perimeter frame 12 are then pulled downward to tightly engage window sill 22. Existing building window frames are frequently not constructed square but are often irregular in inside dimensions. However, it can be seen that the assembly of the present invention can conform to an irregular shape by perimeter frame 12 being slidably adjustable and interfitting within the top channel 15 and side channels 25. Thus, the storm window can be adjusted or tilted within top channel 15 and side channels 25 to conform to the existing window frame and still remain sealed and insulated against air leaks around the edges. In removing the assembly, simply grip tabs 28, push side channels 25 inward together and withdraw downward and out from top channel 15. This easy and simple procedure of installing and removing the assembly 10 of this invention can be accomplished within minimum effort and skill by most any person.

The invention has been described in great detail sufficient to enable one of ordinary skill in the art of interior storm windows to make and use the same. Obviously, modifications and alterations of the preferred embodiment will occur to others upon a reading and understanding of the specification. It is my intention to include all such modifications and alterations as part of my invention insofar as they come within the scope of the appended claims.

According to another aspect of the present invention, a unitary window assembly is generally indicated by the numeral 100. As will be explained hereinbelow in greater detail, unitary window assembly 100 resides within the interior portion of a building or a home and engages the sidewall or jamb of an existing window opening generally indicated by the number 105. Although the present aspect will be discussed with regard to a storm window, it is to be understood that in lieu of a window pane, a screen, or the like, can also be utilized.

Referring to FIG. 1, window pane (or screen) 111 is surrounded by a perimeter frame 115. The perimeter frame comprises side frame portions 116, top frame portion 117 and bottom frame portion 118. The various perimeter frame portions can be mitered in any conventional manner and held together by a suitable fastener such as a screw. The perimeter frame can be of any conventional material known to the art and to the literature such as extruded aluminum, polyvinyl chloride, and the like. Desirably, the perimeter frame contains sealing material 121 so that a waterproof seal is generally made between the frame and the glass pane. Typically, a compression fit is also formed. Seal material 121 can be any conventional material known to the art as well as to the literature and hence can be rubber, plastic, and the like with a specific example being marine glazing. The sealant material is generally resilient and thus due to the pressure exerted upon it by the perimeter frame forms a compression fit as well as resiliently grasps the window pane.

An important aspect of the present embodiment is that an interlocking member 124 exists at or near the end of the perimeter frame. As best seen in FIG. 7, frame interlocking member 124 contains flange 125 thereon. A flange is generally located on each end of the "U" shaped outer periphery of the perimeter frame. Flange 125 extends outward from the plane of the perimeter flange and has an angular projection 127. The projection extends at an angle towards the frame periphery. That is, an acute angle is generally formed between angular projection surface 127 and the frame side. Interlocking member 124 generally exists on at least one side frame portion 116 and desirably on both frame side portions. A similar interlocking connection can also exist on top perimeter frame portion 117.

The unitary window assembly of the present invention is removably and frictionably attached to an existing window opening. That is, it can be readily applied and maintained in position and yet readily and quickly detached from any existing conventional building or home window. The positioning and location of the unitary window assembly 100 of the present invention is within the generally flat, unobstructed jamb portion thereof. By unobstructed it is meant that the place of engagement or residence of the unitary window assembly is free from, that is, outside of any window tracks, guides, and the like and thus resides upon the side jamb area of the opening which is typically flat.

Figure 5:
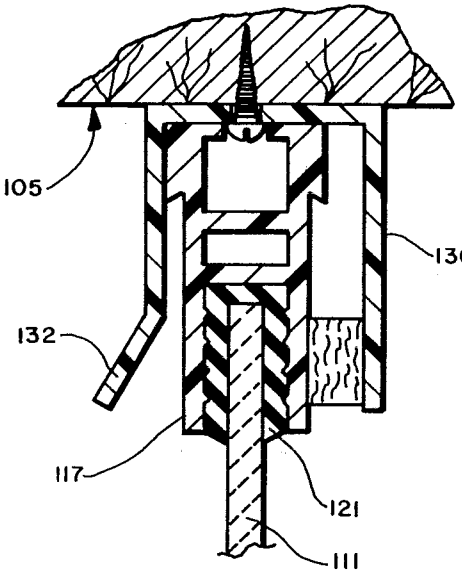
FIG. 5 is a side section view taken substantially through line 5—5 of FIG. 4.
Figure 6:
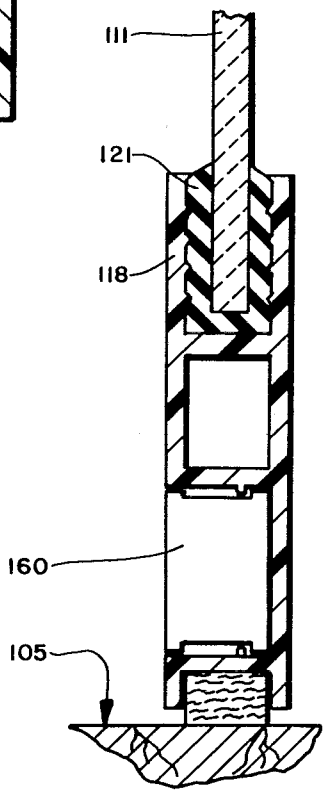
FIG. 6 is a side section view taken substantially through line 6—6 of FIG. 4.
Figure 4:
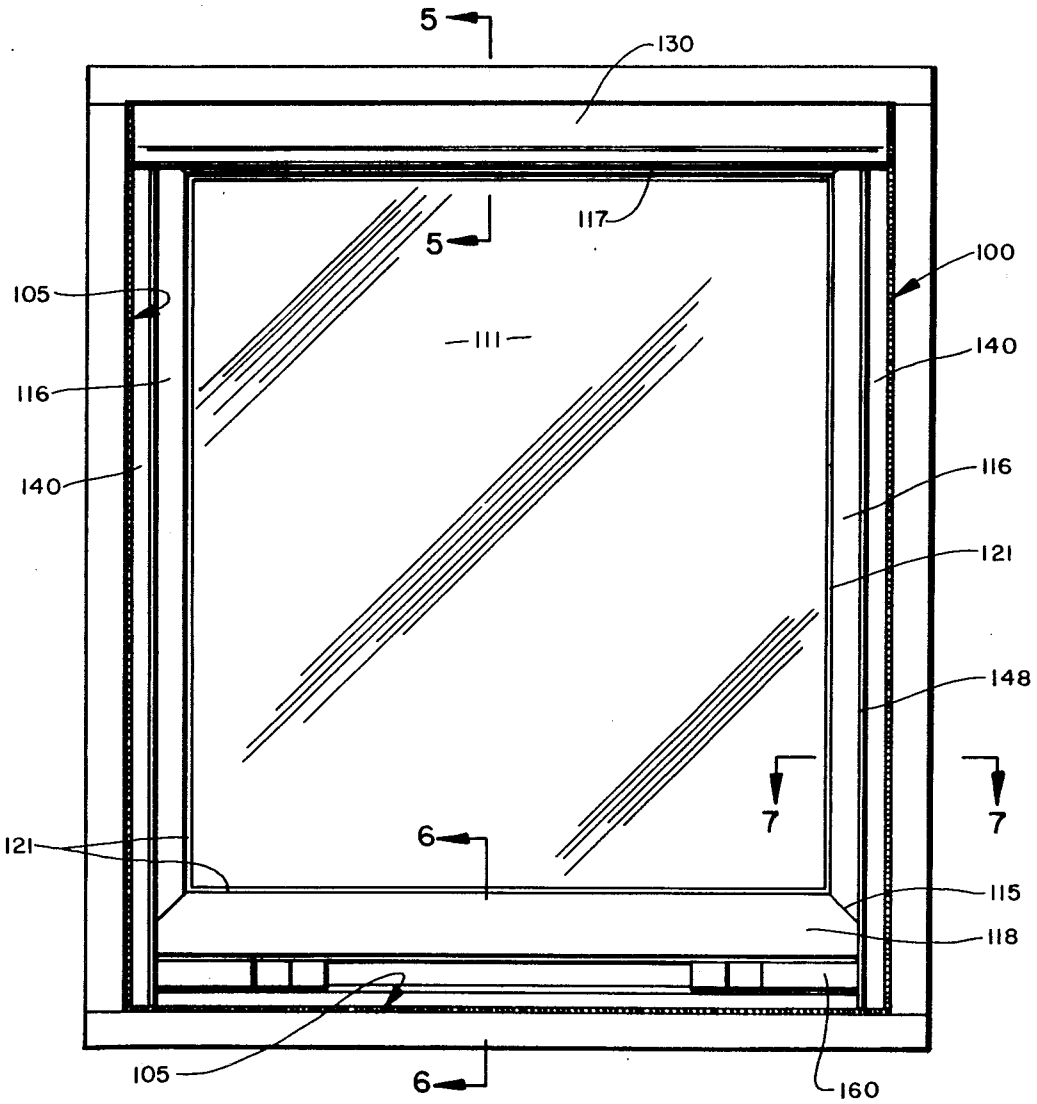
FIG. 4 is a front elevation view of another embodiment of a unitary storm window according to the present invention.

To prevent the window from topping over, a top channel 130 is fastened to the upper portion of the existing window opening as a safety precaution. The top channel can be "U" shaped to permit quick insertion as well as removal of the unitary window assembly. Top channel 130 has a forward extending front edge lip 132 as best seen in FIG. 5. Naturally, the depth of the top channel is sufficient so that when the window is fully seated and rests upon its base, top perimeter frame 117 is securely engaged by top channel 130.

Side channels 140 can generally be of any shape so long as they are slidably and interlockingly connected to the angular projections of side perimeter frame portions 116. As shown in FIG. 7, they can be "U" shaped and have a pair of sidewalls 142. The innermost portion of side channels 140, with respect to the window pane, have inner locking tabs 144 thereon desirably located on each sidewall 142. The interlocking tabs have flanges 145 extending therefrom including an angular projection 147. Angular projections 147 matingly and slidably engage side perimeter frame interlocking member 124. Desirably, an acute angle is formed between the angular projection surface 147 and the sidewall. The interlocking engagement between side channels 140 and the perimeter side frame portion 116 forms a unitary window assembly in that the entire window is held together. That is, even when taken out from an existing open window aperture, the window assembly 100 has no loose parts but will stay together in a fixed relationship as if the entire assembly were integral. In order to assist gripping the window assembly as well as the initial installation of side channels 140 to side perimeter frame portion 116, hand grip tabs 148 project from the side channels.

Since the window assembly of the present invention desirably acts as a storm window, the perimeter thereof desirably has weather stripping or insulation attached thereto. Any conventional weather stripping known to the art and to the literature can be utilized. Accordingly, weather stripping such as wool pile exists in end recess 149 of side channels 140. The weather stripping can be attached thereto in any conventional manner such as through the use of an adhesive. Desirably the weather stripping is a type which does not lose its resiliency under compression for extended periods of time.

It is an important feature of the present invention that at least one of the side channels and preferably both of the side channels are bias against the sidewall jamb of the existing window opening. That is, a bias engagement between unitary window assembly side channels 140 and the existing window opening jamb is desired in order that a frictional fit exists. The bias engagement can be created by the existence of leaf springs 150. One end of leaf spring 150 is generally fixedly attached to a portion of side perimeter recess 129 and the remaining end 155 is desirably moveably attached. Leaf springs 150 are often bowed to create a spring-like effect. Attachment of fixed end 151 can be according to any conventional manner. For example, fixed end 151 of the leaf spring can have a wide neck portion which is wider than the recess opening, and thus fixed end 151 can be inserted into recess 129 and turned such that wide neck cuts into the lips of the recess. Remaining spring end 155 can have a narrow neck such that this end is moveable or slidable within recess 129. Generally, any number of springs 150 can exist such that the entire side channels form a bias engagement with the window opening sidewall or jamb. The bias force of the spring is generally sufficient such that a snug and secure engagement occurs between side channels 140 and the existing window opening sidewalls. The net result is a frictional engagement or fit. That is, the sole source of engagement between unitary window assembly 100 and the sidewalls of the existing window opening is through a pressure or bias engagement. Window tracks, guides, mechanical engagements such as fasteners and the like are not required and not desired. In effect, an obstruction free engagement, that is a frictional fit is achieved.

The installation of the unitary window assembly of the present invention is as follows: Hand tabs 148 on each of the side channels are grasped and the window assembly is carried to an appropriate existing window opening for installation. Unitary window top perimeter frame portion 117 is then pushed upwardly into top channel 130. With the side channels 140 of the unitary window construction forced inward, window assembly 100 is slid into place into the obstruction free, generally flat jambs of an existing window opening 105. Upon release of grip tabs 148, leaf springs 150 will bias side channels 140 into engagement with the jambs of the existing window opening. Since a plurality of springs or bias means exist, should the window opening be irregular, for example wider on top than on the bottom, the springs will accordingly urge the upper portion of the side channels outward to a wider extent. A snug and secure frictional engagement is thus made. Through the use of weather stripping, an essentially air tight engagement is made. The storm window through bottom perimeter frame 118 will reside upon an appropriate surface such as a sill of the existing window opening. The storm window can remain in place throughout a winter season. When it is desired that the detachably unitary window assembly be removed, hand grip tabs 148 are grasped and forced inward. The bottom portion of the window assembly 100 is then pulled outward and downward. No removal of fasteners or the like is required. Since window assembly 100 is unitary, the entire window is removed and no parts of the window assembly such as guideways, tracks, cover flanges, sealing flanges, or the like remain with the sole exception of top channel 130. Upon removal of the unitary frictionally fit unitary window assembly from the obstruction free sidewall jamb, no permanent deformation is created nor must any guides, trackways, or other accessories be removed.

Should a mechanical engagement between the unitary window assembly with the existing window opening sidewall be desired, window assembly 100 can have side latches 160 thereon or bottom latches (not shown), or both. As best seen in FIG. 8, these latches can be any conventional latch such as a spring loaded latch having a projection 162 extending through aperture 163 of the side channels. A corresponding recess can exist in the existing window opening jamb so as to matingly receive bottom latch projection 162. In order to create a weather tight seal, recess 165 can exist on the bottom portion of the latch assembly. The weather stripping can be of any suitable material such as discussed hereinabove.

While in accordance with the Patent Statutes, a best mode and preferred embodiment have been set forth in detail, the scope of the invention is not limited thereby, but rather by the scope of the attached claims.

What is claimed is:

1. A frictionally attachable unitary interior storm window assembly, comprising:

a windowpane, a perimeter frame, said windowpane residing in said perimeter frame, a top channel, said top channel capable of being fastened to the upper portion of an unobstructed jamb of a window opening adjacent to an existing window track, two side channels, each said side channel capable of engaging said unobstructed jamb of said window opening adjacent to an existing window track, each said side channel having interlocking tabs thereon, each said side channel removably interlockingly connected to said perimeter frame so that a unitary window assembly is formed, said side channels being expandable and biasly urged outward against said unobstructed jamb of said window opening so as to form a frictionally attachable and readily removable unitary window assembly, said entire unitary window assembly including said side channels capable of being removably installed in said unobstructed jamb adjacent to said existing window track, wherein said perimeter frame includes two side frame portions, said side frame portions each have interlocking flanges, and wherein said channel tabs matingly engage said perimeter frame interlocking flanges.

2. A unitary interior storm window assembly according to claim 1, wherein said unitary storm window assembly includes at least one bottom or one side latch.

3. A unitary interior storm window assembly according to claim 1, wherein each said side channel contains a spring, said spring located between said perimeter side frame and said side channels, said spring biasing said side channels outward.

4. A unitary interior storm window assembly according to claim 3, wherein said unitary storm window assembly includes at least one bottom or one side latch.

5. A unitary interior storm window assembly according to claim 3, wherein each said side channel slidably engages said perimeter frame.

* * * * *